US009126608B2

(12) United States Patent
Kapp et al.

(10) Patent No.: US 9,126,608 B2
(45) Date of Patent: Sep. 8, 2015

(54) SYSTEMS AND METHODS FOR OPERATING A VEHICLE SYSTEM IN RESPONSE TO A PLAN DEVIATION

(71) Applicant: General Electric Company, Schenectady, NY (US)

(72) Inventors: Kevin L Kapp, Melbourne, FL (US); David Allen Eldredge, Melbourne, FL (US); Robert James Foy, Melbourne, FL (US); Joseph Daniel Wakeman, Lawrence Park, PA (US); John William Brand, Melbourne, FL (US)

(73) Assignee: General Electric Company, Schenectady, NY (US)

( * ) Notice: Subject to any disclaimer, the term of this patent is extended or adjusted under 35 U.S.C. 154(b) by 85 days.

(21) Appl. No.: 13/653,440

(22) Filed: Oct. 17, 2012

(65) Prior Publication Data

US 2014/0107876 A1 Apr. 17, 2014

(51) Int. Cl.
*B61L 3/00* (2006.01)

(52) U.S. Cl.
CPC ..... *B61L 3/006* (2013.01)

(58) Field of Classification Search
CPC ..... G05D 1/00; G05D 1/005; G05D 1/0011; G05D 1/0055; G05D 1/0088; G05D 1/0255; G05D 1/0033; G05D 1/0044; G05D 1/0297; G05D 1/0295; G05D 1/0293; G05D 1/0291; G05D 1/0287; G05D 1/0289; G05D 1/0285; G05D 1/0278; G05D 1/0276; G05D 1/0272; G05D 1/0274; G05D 1/0223; G05D 1/0221; G05D 1/0219; G05D 1/0217; G05D 3/00; G05D 3/165; G05D 3/1436; G05D 2201/0214; G05D 2201/0216; G05D 2201/0213; G05D 2201/0212; G05D 2201/021; G05D 3/186; G05D 3/128; B61L 3/008; B61L 3/006; B61L 3/127; B61L 25/025; B61L 25/021; B61L 2205/04; B61L 15/0027; Y02T 30/38; Y02T 30/40; Y02T 30/36; Y02T 30/34; Y02T 30/10; Y02T 30/32; Y02T 30/30; Y02T 30/18; Y02T 30/16; Y02T 30/14; Y02T 30/12
USPC ..... 701/2, 55, 70, 19, 23, 20, 1, 93; 188/265; 246/187 B; 705/2; 706/55
See application file for complete search history.

(56) References Cited

U.S. PATENT DOCUMENTS 3,246,141 A * 4/1966 Ehrlich ..... 246/34 R
3,805,056 A * 4/1974 Birkin ..... 246/187 B (Continued)

FOREIGN PATENT DOCUMENTS

DE 10226143 B4 * 2/2006

*Primary Examiner* — James Trammell
*Assistant Examiner* — James E Stroud
(74) *Attorney, Agent, or Firm* — GE Global Patent Operation; John A. Kramer

(57) ABSTRACT

A system including a vehicle control module configured to control a vehicle system according to an operating plan. The operating plan designates one or more first tractive operations or braking operations to be implemented by the vehicle system along a trip. The system also includes a planning module for generating a transition plan in response to a deviation from the operating plan. The transition plan designates one or more second tractive operations or braking operations to be implemented by the vehicle system as the vehicle system travels toward an approaching location from a second location where the vehicle system deviates from the operating plan. The planning module is further configured to generate a prospective plan in response to the deviation. The prospective plan is configured to be implemented by the vehicle system when the vehicle system at least one of moves past the approaching location or completes the transition plan.

30 Claims, 3 Drawing Sheets

(56) References Cited

U.S. PATENT DOCUMENTS

| | | | | |
|---|---|---|---|---|
| 3,937,432 | A * | 2/1976 | Birkin | 246/187 B |
| 4,075,632 | A * | 2/1978 | Baldwin et al. | 342/51 |
| 4,932,614 | A * | 6/1990 | Birkin | 246/34 R |
| 5,055,835 | A * | 10/1991 | Sutton | 340/10.4 |
| 5,487,002 | A * | 1/1996 | Diller et al. | 701/1 |
| 6,854,691 | B2 | 2/2005 | Kraeling et al. | |
| 6,862,502 | B2 | 3/2005 | Peltz et al. | |
| 7,140,477 | B2 * | 11/2006 | Engle et al. | 188/265 |
| 7,257,471 | B2 | 8/2007 | Kornick et al. | |
| 7,263,647 | B2 | 8/2007 | Bryant et al. | |
| 7,395,141 | B1 | 7/2008 | Seck et al. | |
| 7,523,893 | B2 * | 4/2009 | Francis et al. | 246/34 A |
| 7,783,397 | B2 | 8/2010 | Peltz et al. | |
| 7,954,770 | B2 * | 6/2011 | Tomlinson et al. | 246/122 R |
| 8,112,189 | B2 | 2/2012 | Peltz et al. | |
| 8,126,601 | B2 | 2/2012 | Kapp et al. | |
| 8,266,092 | B2 * | 9/2012 | Kuhn et al. | 706/55 |
| 8,452,509 | B2 * | 5/2013 | Sujan et al. | 701/70 |
| 8,521,345 | B2 * | 8/2013 | Cooper et al. | 701/19 |
| 8,645,047 | B2 * | 2/2014 | Daum et al. | 701/110 |
| 8,655,518 | B2 * | 2/2014 | Cooper et al. | 701/19 |
| 2003/0187694 | A1 * | 10/2003 | Rowen | 705/2 |
| 2004/0167687 | A1 | 8/2004 | Kornick et al. | |
| 2005/0090978 | A1 * | 4/2005 | Bathory et al. | 701/213 |
| 2005/0143874 | A1 | 6/2005 | Peltz et al. | |
| 2007/0241237 | A1 | 10/2007 | Foy et al. | |
| 2009/0187291 | A1 * | 7/2009 | Daum et al. | 701/2 |
| 2009/0198391 | A1 | 8/2009 | Kumar | |
| 2010/0130124 | A1 | 5/2010 | Teeter et al. | |
| 2011/0060486 | A1 | 3/2011 | Meltser et al. | |
| 2011/0249628 | A1 | 10/2011 | Peltz et al. | |
| 2012/0022728 | A1 * | 1/2012 | Hall et al. | 701/19 |
| 2012/0197504 | A1 * | 8/2012 | Sujan et al. | 701/70 |
| 2012/0245766 | A1 | 9/2012 | Cooper et al. | |
| 2012/0277940 | A1 * | 11/2012 | Kumar et al. | 701/20 |
| 2012/0290185 | A1 * | 11/2012 | Cooper et al. | 701/93 |
| 2013/0131898 | A1 * | 5/2013 | Kumar et al. | 701/20 |
| 2013/0131909 | A1 * | 5/2013 | Cooper et al. | 701/23 |
| 2013/0261837 | A1 * | 10/2013 | Sharma et al. | 701/1 |
| 2013/0261856 | A1 * | 10/2013 | Sharma et al. | 701/19 |
| 2013/0297199 | A1 * | 11/2013 | Kapp et al. | 701/411 |

* cited by examiner

SYSTEMS AND METHODS FOR OPERATING A VEHICLE SYSTEM IN RESPONSE TO A PLAN DEVIATION

Embodiments of the subject matter described herein relate to systems and methods for a vehicle system that is capable of executing tractive and braking operations according to a predetermined or designated operating plan.

BACKGROUND

A transportation network for powered vehicles includes interconnected routes on which powered vehicles travel between locations. The routes connect to one another at intersections, which may also be referred to as junctions, interchanges, crossovers, or turnouts. Powered vehicles can be capable of changing routes at such intersections. By way of one example, a transportation network may be formed from interconnected railroad tracks that are configured to have rail vehicle systems traveling along the tracks. At some intersections, a rail vehicle system (e.g., one or more locomotives optionally coupled with one or more rail cars) may be guided by a turnout switch to change from one route to another route.

Some powered vehicle systems may operate according to a trip or mission plan (also referred to as an operating plan) while traveling along a route. The trip plan may be used, for example, to control operation of the vehicle system so that the vehicle system achieves or operates within certain parameters during the trip. These parameters can include fuel usage, which can be a significant expense in operating a vehicle system, and regulations that limit operation of the vehicle system in some manner. For example, regulations may require that the vehicle system will not exceed speed limits for certain segments of a route, exceed noise levels for certain areas or regions, or exceed national or regional fuel emission standards. Accordingly, the trip plan may be configured to operate the vehicle system in a manner that optimizes one or more parameters (e.g., fuel consumption) while also satisfying other conditions (e.g., speed limits, emissions, arrival time). With respect to a rail vehicle system, the trip plan may be used to automatically control tractive effort and/or braking of the rail vehicle system to arrive at a destination within a designated time while also minimizing the fuel consumption and/or emissions of the trip.

During operation of a vehicle system, however, the vehicle system may receive instructions or be commanded by an operator to deviate from the current trip plan. For instance, when approaching an intersection between two or more tracks, the operator (e.g., engineer) of a rail vehicle system may be notified by a divergence signal that the rail vehicle system should or will change to another track at a turnout switch. But the alternative track may not be part of the original route that was used to determine the trip plan. Presently, the operator may remove the rail vehicle system from automatic control and manually control the vehicle system as the rail vehicle system transitions from one track to the next. Some time after the vehicle system changes to a different track, a new trip plan may be generated, which may take a significant period of time to generate. During this manual operation and delay for trip plan generation, however, the vehicle system may lose fuel saving opportunities and/or time in which the vehicle system could have been automatically controlled. Additionally, this manual operation and delay for trip plan generation can interfere with the schedules of other vehicle systems traveling on the same routes. For example, the trip plans for several vehicle systems traveling within and/or through the same transportation network during the same or overlapping time periods may be based on each other so as to avoid collision or other interferences between two or more moving vehicle systems. If one of the vehicle systems deviates from the trip plan of the vehicle system and is delayed during generation of a new or revised trip plan, then the trip plans of other vehicle systems may be interfered with by the vehicle system that deviates from the trip plan.

Accordingly, a need exists for improved operation of a powered vehicle system when the vehicle system deviates from an operating plan.

BRIEF DESCRIPTION

In one embodiment, a system is provided that includes a vehicle control module that is configured to control a vehicle system during a trip according to an operating plan. The operating plan designates one or more first tractive operations or braking operations to be implemented by the vehicle system along a route of the trip. The system also includes a planning module that is configured to generate a transition plan in response to a deviation of the vehicle system from the operating plan. The transition plan designates one or more second tractive operations or braking operations to be implemented by the vehicle system to achieve a designated operating parameter prior to an approaching location along the route. The vehicle control module is configured to control operation of the vehicle system according to the transition plan as the vehicle system travels toward the approaching location from a location where the vehicle system deviates from the operating plan. The planning module is configured to generate a prospective plan in response to the deviation. The prospective plan designates one or more third tractive operations or braking operations to be implemented by the vehicle system when the vehicle system at least one of moves past the approaching location or completes the transition plan. With respect to the tractive operations and braking operations of the plans, the terms first, second, and third are merely labels to distinguish the operations of one plan from operations of another plan, and are not meant to indicate a particular order or that the operations of a given plan are necessarily the same.

In one embodiment, a method is provided that includes controlling a vehicle system according to an operating plan. The operating plan designates one or more first tractive operations or braking operations to be implemented by the vehicle system along a route of a trip. The method also includes generating a transition plan in response to a deviation of the vehicle system from the operating plan. The transition plan designates one or more second tractive operations or braking operations to be implemented by the vehicle system to achieve a designated operating parameter prior to an approaching location along the route. The method also includes generating a prospective plan in response to the deviation from the operating plan. The prospective plan designates one or more third tractive operations or braking operations to be implemented by the vehicle system when the vehicle system at least one of moves past the approaching location or completes the transition plan.

In one embodiment, a tangible and non-transitory computer readable medium that includes one or more software modules is provided. The computer readable medium is configured to direct a processor to control a vehicle system according to an operating plan. The operating plan designates one or more first tractive operations or braking operations to be implemented by the vehicle system along a route of a trip. The computer readable medium is configured to direct the processor to generate a transition plan in response to a deviation of the vehicle system from the operating plan. The transition plan designates one or more second tractive operations or braking operations to be implemented by the vehicle system to achieve a designated operating parameter prior to an approaching location along the route. The computer readable medium is also configured to direct the processor to generate a prospective plan in response to the deviation from the operating plan. The prospective plan designates one or more third tractive operations or braking operations to be implemented by the vehicle system when the vehicle system at least one of moves past the approaching location or completes the transition plan.

DETAILED DESCRIPTION

Figure 1:
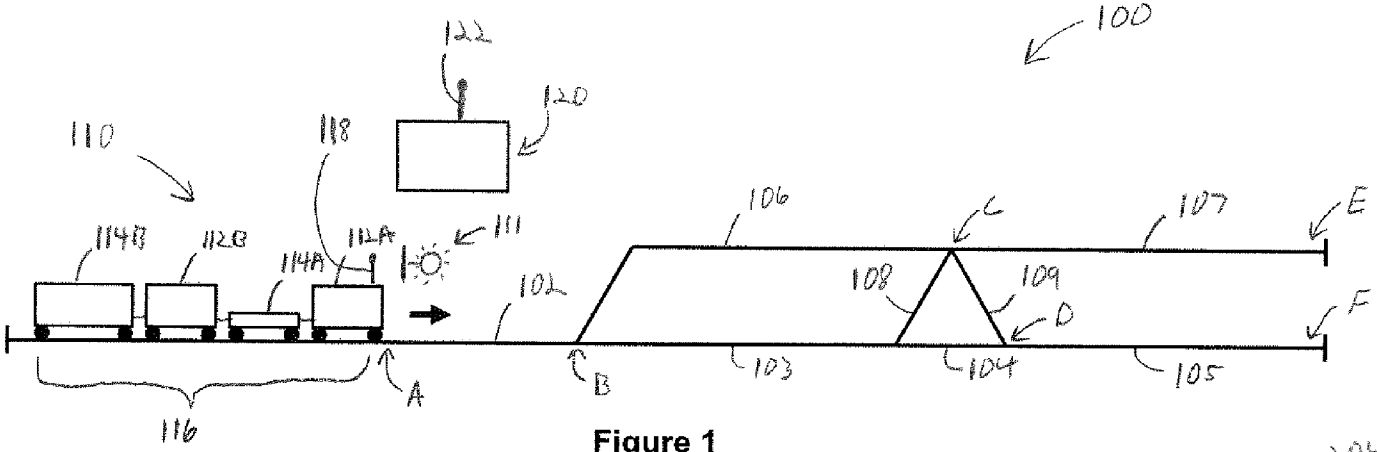
FIG. 1 is a schematic diagram of one embodiment of a transportation network.

One or more embodiments of the inventive subject matter described herein provide methods and systems for generating a plurality of operating plans of a vehicle system (e.g., powered vehicle system) after the vehicle system is notified of a change in an operating plan that is currently being implemented. As described in greater detail below, an operating plan (which may be referred to as a trip plan or mission plan) may include instructions for controlling tractive and/or braking efforts of a vehicle for only a portion of the route or for the entire route. The instructions may be expressed as a function of time and/or distance of a trip along a route. Travel according to these instructions may cause the vehicle system to reduce at least one of fuel consumed and/or emissions generated by the vehicle system compared to the vehicle system traveling along the same trip but according to different instructions of a different operating plan. The vehicle system may be autonomously controlled according to the operating plan or the instructions of the operating plan may be presented to an operator of the vehicle system so that the operator can manually control the vehicle system according to the operating plan (also referred to herein as a "coaching mode" of the vehicle system). The operating plans may be based on trip profiles (described below), which may include, among other things, information about a geography of the route. The operating plans may also or alternatively be based on operating information of the vehicle system, such as the size, weight, tractive effort, power output, weight distribution, and the like, of the vehicle system.

Examples of deviations from the currently-implemented operating plan include at least one of detected route changes, detected changes in speed, or instructions to change the route or speed, which may be based on notifications that alert the vehicle system about an upcoming change in speed limit or upcoming traffic. For instance, the vehicle system may detect a change in speed when the operator manually decelerates or accelerates the vehicle system. As another example, a signaling system may instruct the vehicle system to change routes at an intersection. The signaling system may also instruct the vehicle system to increase or reduce the current speed of the vehicle system to a designated speed. The detected change in speed and the instructions to change routes and/or speed constitute a deviation that may trigger generation of a new operating plan. The new operating plan may account for the changed route and/or speed. Alternatively, the signaling system may notify the vehicle system of an upcoming section of a route having a reduced speed limit. Based on the notification, the vehicle system may determine that the vehicle system must deviate from the currently-implemented plan and reduce the speed.

The operating plans that are generated after the vehicle system is notified of the deviation from the operating plan may be referred to as revised operating plans. Such revised operating plans can include a shorter operating plan (referred to herein as a transition plan) that is calculated to control operation of the vehicle system for a limited distance that is temporally or spatially shorter than the entire trip for which the operating plan was originally generated and/or than the remainder of the trip for which the operating plan was originally generated (e.g., 5 to 7 miles or 8.0 to 11.3 kilometers). Revised operating plans can include a longer operating plan (referred to herein as a prospective plan) that is calculated to control operation of the vehicle system at a later time (e.g., not the current time, such as a designated time period or delay from the current time period) and possibly for a greater distance relative to the transition plan (e.g., 10 to 15 miles or 16.1 to 24.1 kilometers) or until the end of the trip for which the operating plan was originally created. The prospective plan may be implemented after the transition plan is completed or when the vehicle system achieves a designated operating parameter. The shorter transition plan and the longer prospective plan may be based on different factors or the factors may be weighted differently during generation of the plans. In some embodiments, the vehicle system may transfer substantially continuously or seamlessly between two or more operating plans, such as from a currently-implemented operating plan, to the shorter transition plan, and subsequently to the longer prospective plan. For instance, by "substantially continuously or seamlessly," in one embodiment, it is meant that the vehicle system may not request additional commands or inputs from an operator of the vehicle system during the plan transitions.

At least one technical effect of embodiments described herein may include a more continuous or seamless transition of vehicle operation after current operation of a vehicle is interrupted by instructions to modify the vehicle operation. Another technical effect may include enabling automatic control of the vehicle system through a transition between different operating plans or through a change in routes of the vehicle system. Another technical effect may also include, for example, generation of different operating plans that include tractive or braking operations to be executed by the vehicle system after the vehicle system has been notified of a plan divergence. The different operating plans may be generated simultaneously or concurrently or one operating plan may automatically be generated after a previous operating plan is generated. Another technical effect may include a more efficient use of computing resources for generating the different operating plans. Additional technical effects of embodiments may include a reduction in at least one of fuel consumption, fuel emissions, or human interaction with the vehicle system. In some embodiments, a technical effect may include a safer transition or change from one path to another path at an intersection between the paths. In particular embodiments, the intersection may be an intersection between tracks that includes a turnout switch for guiding the vehicle from one track to another. In some embodiments, a technical effect may include a safer transition or change from a current speed to a different speed along a route. A technical effect may be to maintain automatic control through the unplanned track divergence.

In some embodiments, the operating plans may be optimized to achieve designated goals or parameters. As used herein, the term "optimize" (and forms thereof) are not intended to require maximizing or minimizing a characteristic, parameter, or other object in all embodiments described herein. Instead, "optimize" and its forms may include increasing or decreasing (as appropriate) a characteristic, parameter, or other object toward a designated or desired amount while also satisfying other conditions. For example, optimized fuel efficiency may not be limited to a complete absence of fuel consumption or that the absolute minimum amount of fuel is consumed. Rather, optimizing the fuel efficiency may mean that the fuel efficiency is increased or improved, but not necessarily maximized, while also satisfying other conditions (e.g., speed limits, trip duration, arrival time). In some cases, however, optimizing fuel efficiency can include reducing fuel consumption to the minimum amount possible. As another example, optimizing emission generation may not mean completely eliminating the generation of all emissions. Instead, optimizing emission generation may mean that the amount of emissions generated is reduced but not necessarily eliminated. In some cases, however, optimizing emission generation can include reducing the amount of emissions generated to a minimum amount possible.

In one or more embodiments, optimizing a characteristic, parameter, or other object may include increasing or decreasing the characteristic, parameter, or object (as appropriate) during performance of a mission (e.g., a trip) such that the characteristic, parameters, or object is increased or decreased (as appropriate) relative to performing the same mission in another way. For example, the vehicle system traveling along a trip according to an optimized trip plan can result in the vehicle system consuming less fuel and/or generating fewer emissions relative to traveling along the same trip according to another, different trip plan.

FIG. 1 is a schematic diagram of one embodiment of a transportation network 100. The transportation network 100 includes plural interconnected paths 102-109, along which one or more vehicle systems 110 travel. Depending upon the context, the paths 102-109 may be railroad tracks, roads, waterways, airborne paths, or other paths across which a vehicle system may travel. The paths 102-109 or only portions of the paths 102-109 may also be referred to as segments of a route. In the illustrated embodiment, the vehicle system 110 is a rail vehicle system that includes one or more locomotives and, optionally, one or more rail cars that are all linked to one another.

The transportation network 100 may extend over a relatively large area, such as hundreds or thousands of square miles (or kilometers) of land area. While only one transportation network 100 is shown in FIG. 1, one or more other transportation networks 100 may be joined with and accessible to vehicles traveling in the illustrated transportation network 100. For example, one or more of the paths 102-109 may connect to another transportation network (not shown) such that vehicles can travel between the transportation networks. Different transportation networks may be defined by different geographic boundaries, such as different towns, cities, counties, states, groups of states, countries, continents, and the like. The number of paths 102-109 shown in FIG. 1 is meant to be illustrative and not limiting on embodiments of the described subject matter. Moreover, while one or more embodiments described herein relate to a transportation network formed from railroad tracks, not all embodiments are so limited. One or more embodiments may relate to transportation networks in which vehicles other than rail vehicles travel.

Rail vehicle systems may include trains, tram lines, monorails, subways, and the like. One or more other embodiments, however, may relate to vehicle systems other than rail vehicle systems. For example, the vehicle systems may be other off-highway vehicles (e.g., vehicles that are not designed or allowed by law or regulation to travel on public roads, highways, and the like), automobiles, marine vessels, airplanes, and the like. While only one vehicle system 110 is shown in FIG. 1, it is understood that several vehicle systems may be concurrently traveling along the transportation network 100.

A number of points or locations in the network 100 are shown and include points (or locations) A-F. For example, in FIG. 1, the point A may indicate where a vehicle system is currently located and, as such, may be referred to as a current or present location. The points B, C, and D may indicate where the vehicle system is allowed or able to switch or change routes and, as such, may be referred to as intersections or crossover points. The points E and F may be referred to as destination points. It is understood, however, that each of the points A-F may be characterized differently depending on the circumstances. For instance, the points B, C, and D may also be destination points if the operating plan or the route is configured to travel to or through the points. Points may also be referred to as mid-points or route points if the operating plan or the route is configured to travel through the points. Points may also be referred to as end points or final destination points if the operating plan or the route is configured to stop at the points.

Routes may be different based on the paths or segments that constitute the route. By way of example, a first route may extend from the point A to the point F and include the paths or segments 102-105. A second route, however, may also extend from the point A to the point F but include the paths or segments 102, 106, 109, and 105. In this example, although the first and second routes have a common starting point (point A) and a common end point (point F), the first and second routes are different because the first and second routes include different paths or segments. The first and second routes may have, among other things, different total trip distances and different geographies.

Under some circumstances, the vehicle system 110 may be traveling along the path 102 according to an operating plan that is based on the first route described above. As the vehicle system 110 approaches an intersection at point B, however, the vehicle system 110 may be instructed to modify the current route. For instance, the vehicle system 110 may be instructed to change or switch routes so that the vehicle system 110 travels along the path 106 instead of the path 103. This instruction to switch routes may be due to various reasons, such as traffic along the planned route (e.g., another vehicle system on the route), an obstruction along the planned route (e.g., stalled car at a crossing, boulder, snow, etc.), route closure (e.g., drawbridge is up, damage to roads or tracks, repair is being made to roads or tracks, etc.), and the like. As described herein, the vehicle system 110 may receive or generate a transition plan for switching to the segment 106 and, subsequently, a prospective plan that is implemented after the transition plan or when a designated operating parameter is achieved.

By way of one example, the vehicle system 110 may be a rail vehicle that includes one or more locomotives and, optionally, one or more rail cars. The paths or segments 102, 103, and 106 may be railroad tracks. While traveling along the path 102, the operator of the rail vehicle system 110 may be notified through a divergence signal (e.g., flashing light) by a signaling system 111 (e.g., railway signal light) that the vehicle system 110 must modify its course and change routes at a turnout switch located at point B. In order to change routes and move from the path 102 to the path 106, the rail vehicle system 110 may be required to slow the current vehicle speed to a speed that is no greater than a designated speed (e.g., a speed limit). To this end, the transition plan may be configured to control operation of the rail vehicle system 110 so that the rail vehicle system 110 achieves the designated speed prior to reaching the point B. In other embodiments, the vehicle system 110 may be instructed to increase or decrease the current speed of the vehicle system 110 without changing routes. For example, the signaling system 111 may notify the vehicle system 110 that a speed limit for a designated portion of the route has changed or that the vehicle system 110 is moving at a speed above the speed limit.

The subsequent prospective plan may be configured to control operation of the vehicle system 110 so that the vehicle system 110 arrives at a designated point (e.g., the point F) by a designated time (e.g., scheduled arrival time) or achieves one or more operating parameters (e.g., fuel efficiency, fuel emissions, etc.) by another point, by a certain time, for a designated portion of the trip, or for the entire trip. In some embodiments, the prospective plan may be a first prospective plan and a second prospective plan is generated to be implemented after the first prospective plan.

As shown in FIG. 1, the vehicle system 110 may include a group of powered units 112A, 112B (e.g., locomotives or other vehicles capable of self-propulsion) and/or non-powered units 114A, 114B (e.g., rail cars, cargo cars, passenger cars, or other vehicles incapable of self-propulsion) that are mechanically coupled or linked together (directly or indirectly) to travel along the paths 102-109. The term "powered" refers to the capability of the units 112A, 112B to propel themselves and not to whether the units 112A, 112B or the units 114A, 114B receive energy (e.g., electric current) for one or more purposes. For example, the non-powered units 114A, 114B may receive electric current to power one or more loads disposed on-board the non-powered units 114A, 114B.

In FIG. 1, the powered unit 112A may be considered a lead powered unit of a vehicle consist 116, and the powered unit 112B may be considered a remote powered unit of the vehicle consist 116. The embodiment of FIG. 1 is provided for illustrative purposes only, as other arrangements, orientations, and/or numbers of powered units and/or non-powered cars may be used in other embodiments. In some embodiments, the lead powered unit 112A may control the operations of other, remote powered units, such as the remote powered unit 112B. In other embodiments, a powered unit other than the lead powered unit may act to control the operations of one or more other powered units. For example, the remote powered unit 112B may control operations of the lead powered unit 112A.

As shown in FIG. 1, the transportation network 100 may include a network system or monitoring system 120 that can be disposed off-board (e.g., outside) of the vehicle system 110. For example, the network system 120 may be disposed at a central dispatch office for a railroad company. The network system 120 can generate and communicate the various operating plans described herein (e.g., current operating plans, transition plans, prospective plans, and the like). The network system 120 can include a wireless antenna 122 (and associated transceiving equipment), such as a radio frequency (RF) or cellular antenna, that wirelessly transmits instructions to the vehicles 110. The vehicle system 110 may also include a wireless antenna 118 (and associated transceiving equipment). For example, the network system 120 may transmit updated destination locations and associated arrival times to the vehicle system 110. The network system 120 may also receive information from the vehicle system 110 to analyze or pass along to a central data store or analysis center.

In some embodiments, the vehicle system 110 is or includes a vehicle consist or includes a plurality of vehicles consists. As used herein, a "vehicle consist" includes at least one powered unit that is capable of self-propulsion. In some cases, a vehicle consist includes a plurality of powered units that are directly or indirectly coupled to one another. The plurality of powered units in a single vehicle consist may be configured to operate as a single moving apparatus. For example, the multiple powered units may be controlled by a computing system that coordinates tractive and/or braking efforts to control operation of the vehicle system that includes the vehicle consist. A single vehicle system may be or include a single vehicle consist or include a plurality of vehicle consists that are directly or indirectly coupled to another. When a vehicle system includes multiple vehicle consists, the consists may be referred to as sub-consists. If the vehicle system includes multiple vehicle consists, the vehicle consists may be configured to operate as a single moving apparatus. For example, the multiple vehicle sub-consists may be controlled by a master computing system that coordinates tractive and/or braking efforts among the sub-consists to control operation of the vehicle system that includes the vehicle sub-consists.

In some embodiments, the vehicle system 110 is characterized as having a distributed power system or being capable of operating in different modes. In a distributed power system, different powered units (or different vehicle consists) are capable of operating according to different instructions. For example, a single vehicle system may include first and second powered units (or first and second vehicle consists). A single master controller or computing system for the vehicle system may instruct the first and second powered units in a manner that coordinates tractive and/or braking efforts of the vehicle system. However, the master computing system may communicate different instructions to them. For example, the first powered unit may be instructed to operate at a high notch (or throttle) setting. At the same time, the second powered unit may be instructed to operate at a lower notch setting or to apply brakes to the powered unit.

As one specific example, a vehicle system may include a lead vehicle consist and a remote vehicle consist. As the vehicle system is traversing a mountain, the lead vehicle consist may crest the mountain top and travel on the downward slope of the mountain. At this time, the lead vehicle consist may be instructed to cease tractive efforts and commence braking The remote vehicle consist, however, may not have passed the mountaintop and may still be climbing this mountain. If so, the remote vehicle consist may be instructed to maintain tractive efforts. By operating the lead and remote vehicle consists in a different manner, tensile forces at the mechanical couplers that connect the rail cars and locomotives may be reduced. As such, different powered units or vehicle consists of a single vehicle system may operate asynchronously or independent from each other. This may also be referred to as operating according to an asynchronous mode, independent mode, or decoupled mode.

Figure 2:
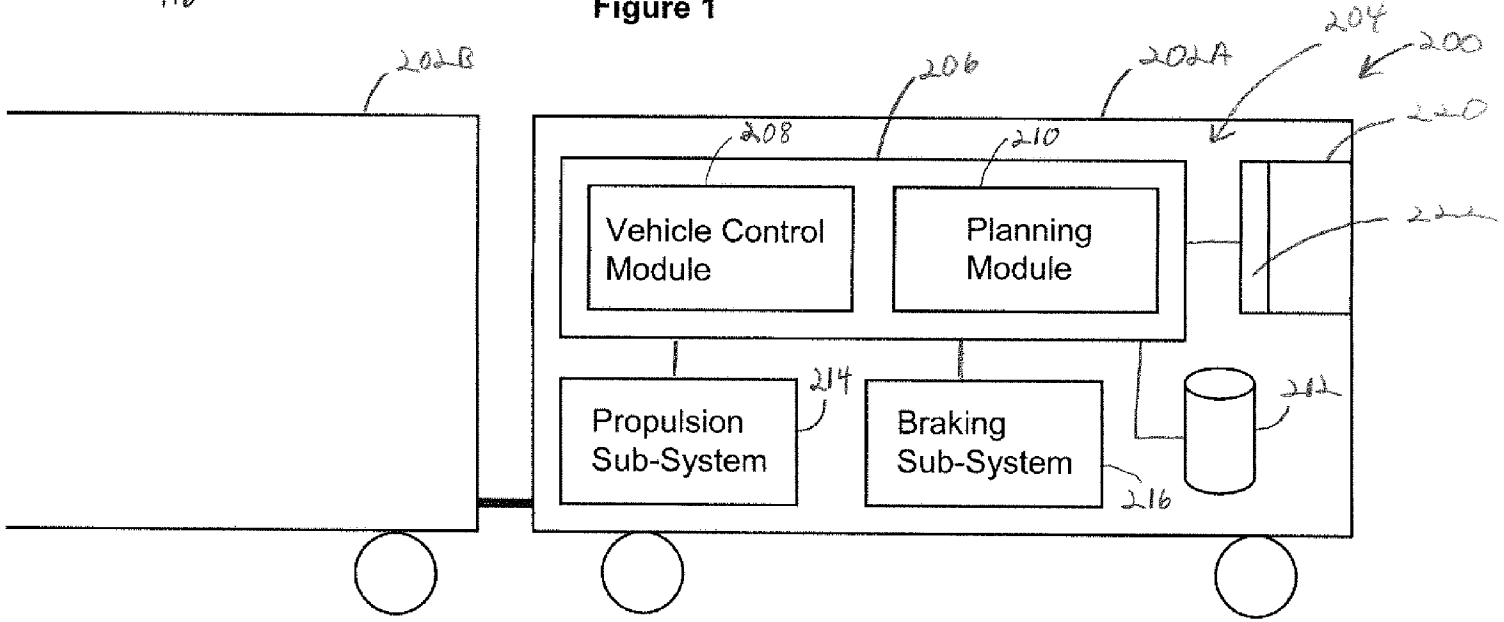
FIG. 2 is a schematic diagram of one embodiment of a powered vehicle that includes a vehicle control module and a planning module.

FIG. 2 is a schematic diagram of a vehicle system 200 that includes a plurality of powered units 202A, 202B. The vehicle system 200 may be similar to the vehicle system 110 (shown in FIG. 1). The powered unit 202A may be referred to as a lead powered unit and the powered unit 202B as a remote powered unit. Powered units that control other powered units may be referred to as "lead" or "master" powered units, and powered units that are controlled by other powered units may be referred to as "remote" powered units. The powered units 202A, 202B may constitute or be part of a vehicle consist that may or may not be coupled with other vehicle consist(s) (not shown) in the vehicle system 200. In the illustrated embodiment, the powered unit 202A includes a control system 204 that is configured to control operation of the powered units 202A and 202B. In other embodiments, the powered unit 202B may include a control system that is configured to control operation of the powered unit 202A. In such embodiments, the powered unit 202B may be referred to as the lead powered unit. Alternatively, the control system may be distributed between the powered units 202A, 202B. For embodiments that include multiple vehicle consists, the control system 204 may be configured to control operation of other vehicle consists.

The control system 204 may include a user interface 220 that is configured to interact with an operator (e.g., engineer) of the vehicle system 200. The user interface may include hardware, firmware, software, or a combination thereof that enables an individual (e.g., the operator) to directly or indirectly control operation of the vehicle system 200 and the various components thereof. As shown, the user interface 220 includes an operator display 222. The operator display 222 may be one or more displays that are oriented to be viewed by the operator.

The user interface 220 may be configured to receive inputs from the operator. The inputs may include, for example, instructions to deviate or diverge from a currently-implemented plan as described herein. To this end, the user interface 220 may also include one or more input devices (not shown), such as a levers, switches, buttons, handles, and the like. The user interface 220 may also include a touchpad or touch-sensitive display (e.g., touchscreen) that can detect a presence of a touch from an operator of the vehicle system 200 and can also identify a location in the display area of the touch.

The control system 204 may include a controller 206 having a plurality of modules including a vehicle control module 208 and a planning module 210. The controller 206 may be a computer processor or other logic-based device that performs operations based on one or more sets of instructions (e.g., software). The instructions on which the controller 206 operates may be stored on a tangible and non-transitory (e.g., not a transient signal) computer readable storage medium, such as a memory 212. The memory 212 may include one or more computer hard drives, flash drives, RAM, ROM, EEPROM, and the like. Alternatively, one or more of the sets of instructions that direct operations of the controller 206 may be hard-wired into the logic of the controller 206, such as by being hard-wired logic formed in the hardware of the controller 206.

The controller 206 includes the vehicle control and planning modules 208, 210, which may perform the various operations described herein. The modules 208, 210 are shown as being included in or part of the controller 206. The modules 208, 210 may include hardware and/or software systems that operate to perform one or more functions. Alternatively, one or more of the modules 208, 210 may include a controller (not shown) that is separate from the controller 206, or may be combined to form a composite module or controller.

The vehicle control module 208 is configured to control operation of the vehicle system 200 according to one or more operating plans in which the operating plans designate at least one of tractive operations or braking operations to be implemented by the vehicle system 200. In one embodiment, the control module 208 may autonomously control operations of the vehicle system 200 according to an operation plan. Optionally, the control module 208 can provide instructions (e.g., textual instructions, graphical instructions, audible instructions, and the like) to an operator of the vehicle system 200 in order to direct (e.g., guide or coach) the operator to manually control the vehicle system 200 according to the operating plan. As shown, the vehicle system 200 may include a propulsion sub-system 214 and a braking sub-system 216. The propulsion sub-system 214 may include one or more engines (not shown) or motors for driving the vehicle system 200. More specifically, the propulsion sub-system 214 may provide a tractive effort or a tractive operation that moves the vehicle system 200. The propulsion sub-system 214 may be capable of operating the engines at different notch (or throttle) settings. In FIG. 2, the propulsion sub-system is part of the powered unit 202A. In other embodiments, the propulsion sub-system 214 that is controlled by the vehicle control module 208 is distributed across multiple powered units or vehicle consists. For example, the propulsion sub-system 214 may also be part of the powered unit 202B.

The braking sub-system 216 may include a plurality of systems or assemblies, including a brake assembly (not shown) on the powered units 202A, 202B and a brake assembly (not shown) on non-powered units. The braking sub-system 216 may include air brakes and/or regenerative brakes. In some cases, the braking sub-system 216 may be characterized as including a dynamic braking system. For embodiments that include air brake systems, the braking sub-system 216 may be configured to supply air pressure to or controllably vent a pressurized brake pipe (not shown). The pressurized brake pipe may be in fluid communication with each of the non-powered units and/or other powered units in the vehicle system 200 or a vehicle consist.

The propulsion and braking sub-systems 214, 216 are communicatively coupled to the vehicle control module 208. The propulsion and braking sub-systems 214, 216 are configured to receive control signals from the vehicle control module 208 that instruct the propulsion and/or braking sub-systems 214, 216 to operate in a designated manner. The propulsion and/or braking sub-systems 214, 216 may communicate information back to the vehicle control module 208 regarding a status of the propulsion and/or braking sub-systems 214, 216 or other information, such as signals from sensors (not shown).

The planning module 210 is configured to obtain one or more operating plans. The planning module 210 may create the operating plans and/or receive the operating plans from an off-board location. For instance, the planning module 210 may generate another operating plan in response to a deviation of the vehicle system from the operating plan that is currently being implemented. The deviation may be an actual or present deviation. For example, the vehicle system may detect that the operator has manually changed the speed of the vehicle system. The deviation may also be a planned deviation. For instance, the vehicle system may receive instructions to change routes at an approaching intersection. The detected change in speed or the instructions to change routes may constitute a deviation that triggers generation of another operating plan. In the illustrated embodiment, the planning module 210 is disposed on-board the vehicle system 200 with the vehicle-control module 208. In other embodiments, the planning module 210 may be disposed on-board the vehicle system 200, but on a different powered unit. In yet other embodiments, the planning module 210 is disposed off-board. For example, the network system 120 (FIG. 1) may include the planning module 210.

The planning module 210 may generate operating plans that are based on at least one of an operating parameter (or characteristic), operating restriction (or constraint), and the like of the vehicle system 200. Operating parameters (or characteristics) relate to the physical or mechanical operation relating to movement of the vehicle system or characteristics that are a result of such operation. Examples of operating parameters include, but are not limited to, vehicle speed, horsepower, notch (throttle) settings, brake settings, fuel usage, emissions, train weight, drag coefficients, friction modifier, etc. Operating restrictions (or constraints) may relate to the physical or mechanical limitations of the vehicle system or external limitations that are directed to the vehicle, such as regulations. Examples of operating restrictions include, but are not limited to, speed limits, lower and/or upper limits on notch (throttle) settings, upper cumulative and/or instantaneous emissions permitted in a region, etc.

The planning module 210 is configured to use at least one of vehicle data, route data (or a route database), or trip data to generate the operating plan. In some cases, the vehicle data, route data, and the trip data include information relating to the operating characteristics, parameters, restrictions, and constraints described above. The vehicle data may include information on the characteristics of the vehicle. For example, when the vehicle system 200 is a rail vehicle, the vehicle data may include a number of rail cars, number of locomotives, information relating to an individual locomotive or a consist of locomotives (e.g., model or type of locomotive, weight, power description, performance of locomotive traction transmission, consumption of engine fuel as a function of output power (or fuel efficiency), cooling characteristics), load of a rail vehicle with effective drag coefficients, vehicle-handling rules (e.g., tractive effort ramp rates, maximum braking effort ramp rates), content of rail cars, lower and/or upper limits on power (throttle) settings, etc. By way of one particular example, the planning module 210 may consider information regarding the fuel efficiency of the vehicle system 200 (e.g., how much fuel is consumed by the vehicle system 200 to traverse different segments of a route), the tractive power (e.g., horsepower) of the vehicle system 200, the weight or mass of the vehicle system 200 and/or cargo, the length and/or other size of the vehicle system 200, and the location of the powered units in a vehicle system (e.g., front, middle, back, or the like of a vehicle system having several mechanically interconnected units).

Route data may include information on the route, such as information relating to the geography or topography of various segments along the route (e.g., effective track grade and curvature), speed limits for designated segments of a route, maximum cumulative and/or instantaneous emissions for a designated segment of the route, locations of intersections (e.g., railroad crossings), locations of certain track features (e.g., crests, sags, curves, and super-elevations), locations of mileposts, and locations of grade changes, sidings, depot yards, and fuel stations. The route data, where appropriate, may be a function of distance or correspond to a designated distance of the route. The information related to the route to be traversed by the vehicle system 200 may also include the existence and/or location of known slow orders or damaged segments of the route, and the like. Other information can include information that impacts the fuel efficiency of the vehicle system 200, such as atmospheric pressure, temperature, and the like.

Trip data may include information relating to a designated mission or trip, such as start and end times of the trip, start and end locations, route data that pertains to the designated route (e.g., effective track grade and curvature as function of milepost, speed limits), upper cumulative and/or instantaneous limits on emissions for the trip, fuel consumption permitted for the trip, historical trip data (e.g., how much fuel was used in a previous trip along the designated route), desired trip time or duration, crew (user and/or operator) identification, crew shift expiration time, lower and/or upper limits on power (throttle) settings for designated segments, etc.

In some cases, a trip profile may be created by or provided to the planning module 210. The trip profile may include the information that is associated with a designated trip. More specifically, the trip profile may include the vehicle data, route data, and the trip data described above for a designated route. The operating plan may be formulated by the planning module 210 based on the trip profile. The planning module 210 may analyze the train data, trip data, and track data corresponding to the designated route for a trip. Based on this analysis, the planning module 210 may develop the operating plan. Methods to compute an operating plan may include, but are not limited to, direct calculation of the operating plan using differential equation models which approximate the train physics of motion. In other cases, the planning module 210 may modify a known or previously-generated operating plan.

For example, if the trip profile requires the vehicle system 200 to traverse a steep incline and the trip profile indicates that the vehicle system 200 is carrying significantly heavy cargo, then the planning module 210 may form an operating plan that includes or dictates increased tractive efforts to be provided by the propulsion sub-system 214 of the vehicle system 200. Conversely, if the vehicle system 200 is carrying a smaller cargo load and/or is to travel down a decline in the route based on the trip profile, then the planning module 210 may form an operating plan that includes or dictates decreased tractive efforts by the propulsion sub-system 214 for that segment of the trip. In one embodiment, the planning module 210 includes a software application or system such as the Trip Optimizer™ system developed by General Electric Company.

Figure 3:
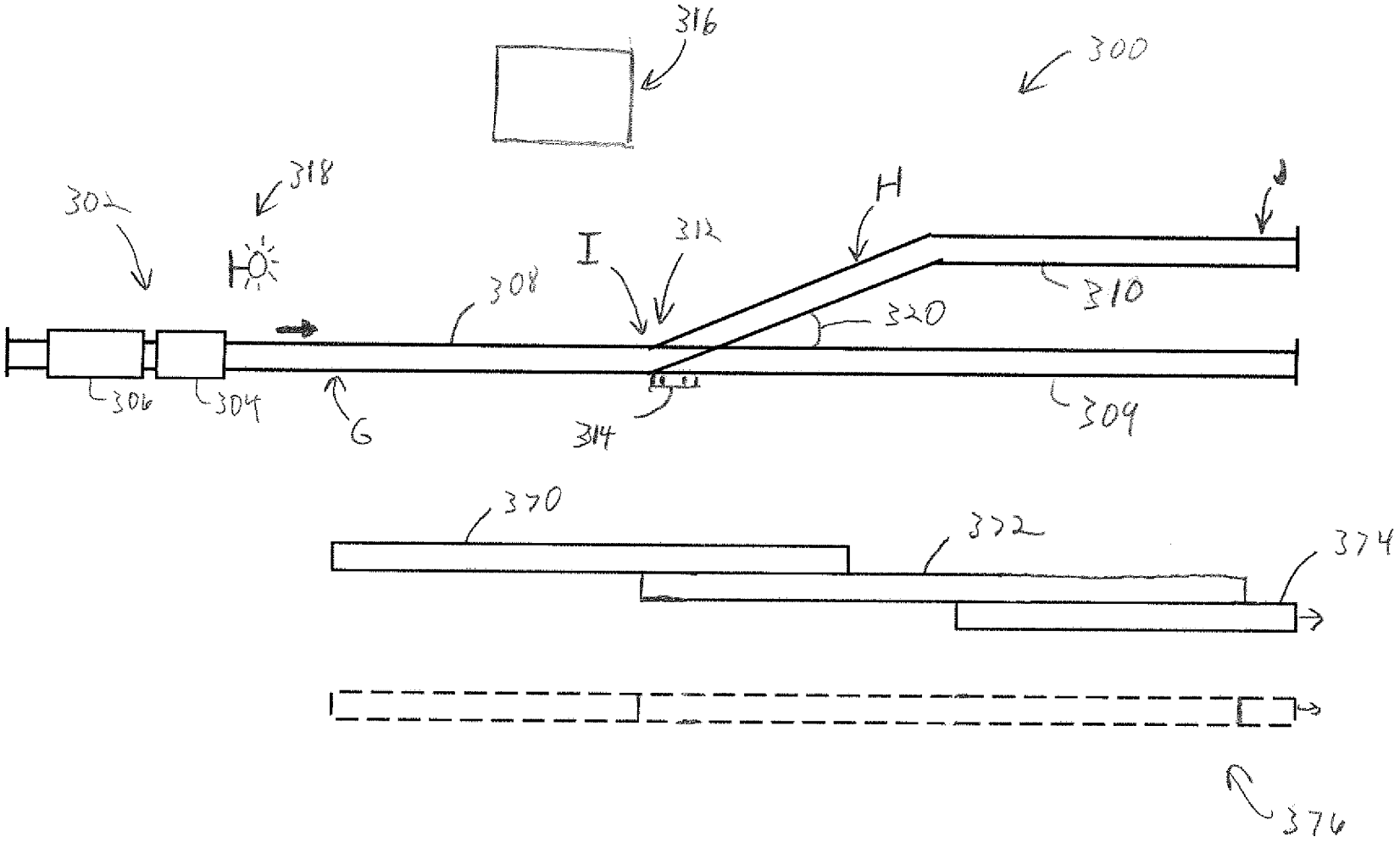
FIG. 3 is a schematic diagram of another transportation network and illustrates implementation of multiple operating plans during operation of a powered vehicle.

FIG. 3 is a schematic diagram of a transportation network 300 that includes segments 308-310 and has a vehicle system 302 that is capable of traveling along the segments 308-310. The vehicle system 302 may be similar to the vehicle systems 110 (FIG. 1) and 200 (FIG. 2) described above. In the illustrated embodiment, the vehicle system 302 is a rail vehicle system that includes at least a locomotive 304 and a rail car 306. As shown, the segments 308-310 intersect each other at an intersection or junction 312. The intersection 312 includes a turnout switch 314 that guides the vehicle system 302 in a designated manner. Also shown, the transportation network 300 includes a network system 316 and a signaling system 318.

The turnout switch 314 is configured to guide the vehicle system 302 to the segment 309 or to the segment 310, depending on the state of the switch 314 (e.g., a first state may cause the vehicle system 302 to travel onto the segment 309 while another, second state may cause the vehicle system 302 to travel onto the segment 310). In the context of railroad tracks, the turnout switch 314 may have one or more mechanisms that change a configuration of the rails at the intersection 312 so that the vehicle system 302 is guided in a designated direction (e.g., either onto the segment 309 or onto the segment 310). The turnout switch 314 may be any one of various types of turnout switches. Examples of turnout switches include slip switches (e.g., single slip, double slip, outside slip), crossovers, stub switches, plate switches, three-way switches, interlaced turnouts, wye switches, dual gauge switches, rack railway switches, switch diamonds, etc. Each of the above turnout switches may have a different mechanical configuration or a different mechanism for adjusting the rails to direct the vehicle system in the designated direction. At least some of these mechanical configurations or mechanisms may be considered when determining a crossover speed for the vehicle system 302. For example, the turnout switch 314 may have a diverging angle 320. As the diverging angle 320 decreases, the crossover speed may increase in accordance with one embodiment.

Figure 4:
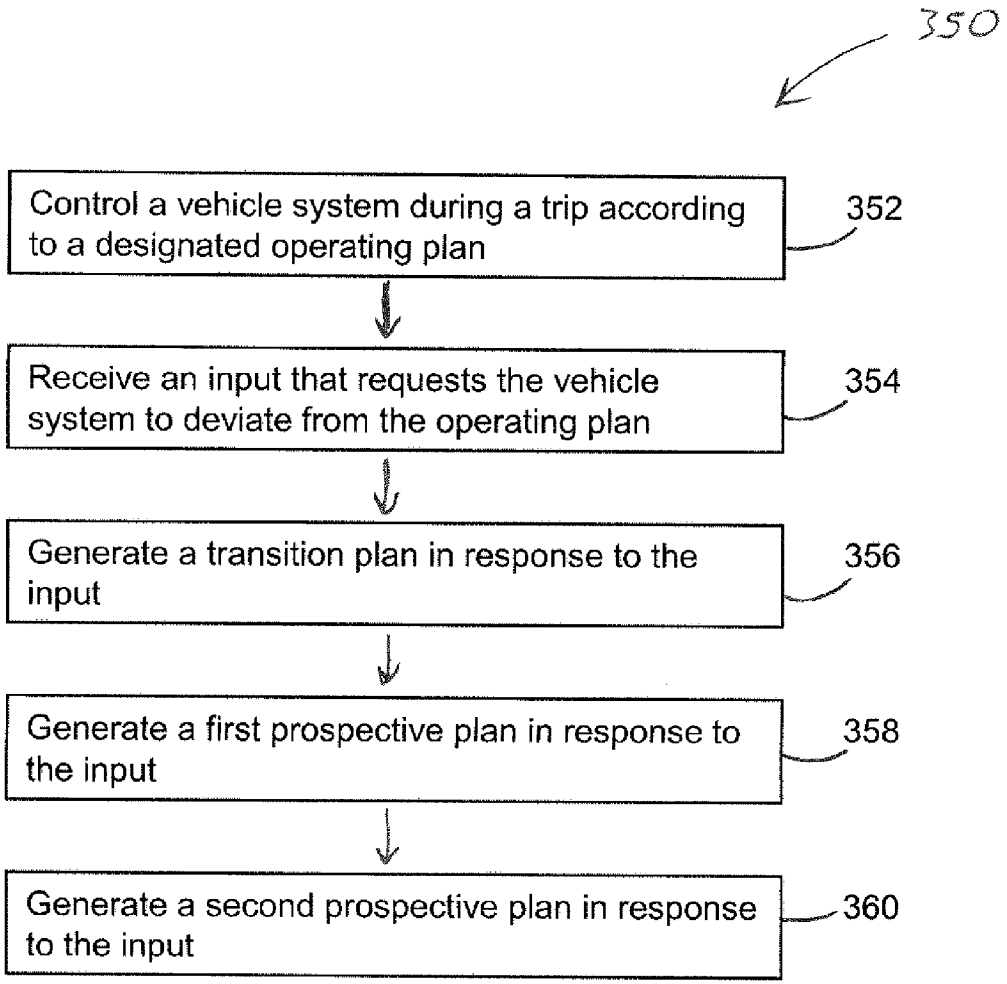
FIG. 4 is a flowchart of one embodiment of a method for generating multiple operating plans in response to a change in a currently-implemented plan.

FIG. 4 is a flowchart of a method 350 for generating multiple operating plans in accordance with one or more embodiments. FIG. 4 is described with reference to the elements shown in FIG. 3. As shown, the vehicle system 302 is heading in a direction indicated by the arrow while implementing an operating plan (referred to as the current operating plan). The current operating plan is based on, among other things, a designated route that includes the segments 308, 309. The vehicle system 302 is approaching the intersection 312 (which also may be referred to as the approaching location). In some embodiments, the approaching location may be relatively close. For example, the approaching location may be less than or equal to 3000 feet (e.g., 915 meters) from the vehicle system 302 or less than or equal 2000 feet (e.g., 610 meters). In more particular embodiments, the approaching location may be less than or equal to 1500 feet (e.g., 457 meters) from the vehicle system 302.

The method 350 (FIG. 4) includes controlling (at 352) the vehicle system 302 during a trip according to a predetermined or designated operating plan. In some embodiments, the operating plan is generated by a planning module, such as the planning module 210 (FIG. 2). The planning module may be on-board or off-board. For example, the planning module may be part of a control system on the vehicle system 302 as described above or the planning module may be part of a master computing system (not shown) of the network system 316 that is configured to send operating plans to the vehicle system 302 and other vehicle systems in the transportation network 300. The network system 316 may also receive and/or provide information to the vehicle system 302, such as the information required for generating the operating plans (e.g., vehicle data, route data, trip data, etc.).

The method 350 may also include receiving (at 354) an input that requests the vehicle system 302 to deviate from the operating plan. The input may be a user input that is provided by an individual, such as the operator or engineer. For example, in the illustrated embodiment, the signaling system 318 may include a flashing light or other indicator that informs the operator that the vehicle system 302 should change to the segment 310 at the intersection 312 instead of proceeding onto the segment 309. Upon seeing the flashing light, the operator may provide an input to a user interface of the vehicle system 302. The input may include an instruction to modify the route by changing paths at the intersection 312. For instance, the input may request that the vehicle system 302 prepare for the turn onto the segment 310. The vehicle system 302 may determine that the segment 310 is not part of the designated route and initiate generation of a transition plan and at least one prospective plan.

In some embodiments, the signaling system 318 may include a flashing light or other indicator that informs the operator that the vehicle system 302 should increase or decrease the current speed of the vehicle system 302 without changing routes. Such a situation may occur when, for example, another vehicle system is on the same route and heading in the same direction as the vehicle system 302, but at a different speed. If the other vehicle system is ahead of the vehicle system 302 and traveling at a slower speed, it may be desirable to reduce the speed of the vehicle system 302. If the other vehicle system is behind the vehicle system 302 and traveling at a greater speed, it may be desirable to increase the speed of the vehicle system 302. Such a situation may also occur when the vehicle system 302 is traveling at a speed that is greater than a designated speed limit. After notification, the operator may provide an input to the user interface of the vehicle system 302. The input may include an instruction to modify (e.g., increase or decrease) the current speed of the vehicle system 302. The instruction may also indicate a designated point (e.g., an approaching location) by which the modified speed must be achieved.

In some embodiments, the input request is detected automatically when the vehicle system actually deviates from the operating plan. For example, if the operator or the control system of the vehicle system 302 provides an instruction that is inconsistent with the operating plan or if the operator or the control system controls the vehicle system 302 in a manner that is inconsistent with the operating plan, the vehicle system 302 may automatically generate the transition plan and the prospective plan(s). Controlling the vehicle system 302 in an "inconsistent manner" may include applying a brake effort or tractive effort when the currently-implemented operating plan did not have such an effort planned. Controlling the vehicle system 302 in an inconsistent manner may also include the operator interrupting automatic control while the operating plan is being implemented to execute manual operations.

In other cases, the signaling system 318 or the network system 316 may communicate the input (e.g., instructions) to the vehicle system 302. For instance, the signaling system 318 or the network system 316 may determine that the vehicle system 302 should change routes and/or speed and communicate with the control system of the vehicle system 302 such instructions. In other embodiments, the vehicle system 302 may provide the input itself. For example, after receiving and calculating updated route or traffic information, the planning module of the vehicle system may determine that the vehicle system 302 should turn onto the segment 310 or reduce the speed while remaining on the same segment 309. Accordingly, the vehicle system 302 may receive an input from an individual or a remote system (e.g., the signaling system 318 or the network system 316) or the vehicle system 302 may generate the input itself Accordingly, the method 350 may include generating (at 356) a transition plan 370 in response to the input and generating (at 358) a prospective plan 372 in response to the input. The transition and prospective plans 370, 372 are operating plans that are applied to different portions or segments of the route. For example, the transition plan may designate one or more tractive or braking operations to be implemented by the vehicle system 302 to achieve a designated operating parameter prior to the intersection 312 or other location along the route. The prospective plan may designate one or more tractive or braking operations to be implemented by the vehicle system 302 past the intersection 312 (or the other location). In some embodiments, the prospective plan 372 is generated as the transition plan 370 is being generated and/or after the transition plan 370 is generated. For example, the prospective plan 372 may be generated at least partially concurrently with the transition plan 370 or after the transition plan 370 is generated.

The transition and prospective plans 370, 372 may be generated by a planning module as described above and be based on at least one of an operating characteristic or operating constraint and at least one of vehicle data, route data, or trip data. The transition and prospective plans may be based on at least one of (a) different factors (e.g., different operating parameters or constraints and/or different route or trip data); (b) a different number of factors; or (c) common factors, but the factors may be weighted differently.

As shown in FIG. 3, the transition and prospective plans 370, 372 correspond to different portions of the route. The transition plan 370 begins at point G and extends to point H, which is located beyond the intersection 312. The prospective plan 372 may begin at a point I, which is approximately located at the intersection 312, extend beyond point H to a point J. The transition plan 370 may be shorter than the prospective plan 372. By way of one specific example, the transition plan 370 may correspond to about 5 to 7 miles (e.g., 8.0 to 11.3 kilometers) of railroad tracks, and the prospective plan 372 may correspond to about 15 miles (e.g., 24.1 kilometers) of railroad track.

The transition and prospective plans 370, 372 may be configured for different purposes. For example, the transition plan may be configured to achieve a designated operating parameter prior to the intersection 312 along the route. In the illustrated embodiment of FIG. 3, the designated operating parameter may be a crossover speed, which is a vehicle speed that allows the vehicle system 302 to safely change paths at the intersection 312. In particular, the transition plan 370 may be configured to reduce the speed of the vehicle system 302 so that the vehicle system 302 can be safely guided by the turnout switch 314 onto the segment 310.

As described above with respect to the operating plans, the transition plan 370 may be based on route data and vehicle data. For instance, the grade and curvature of the track between the points G and H may be considered in determining how to reduce the speed of the vehicle system 302. Moreover, a total weight of the vehicle system may be considered. The transition plan may also be based on the type(s) of braking system(s) and effectiveness of the braking system(s) and whether the vehicle system 302 is a distributed power system that is capable of operating in an asynchronous mode.

In some embodiments, the transition plan 370 may be based on a route transition characteristic. The route transition characteristics are characteristics or factors that may be considered by the planning module in generating a plan to achieve the designated operating parameter prior to the approaching location (e.g., the intersection 312). The route transition characteristic may be a characteristic that is based on the turnout switch 314 (referred to as a switch characteristic). Switch characteristics can include, by way of example, the type of turnout switch (e.g., structure or mechanism of the turnout switch), a value of the diverging angle 320, the age of the turnout switch 314, and the like. Other route transition characteristics may be characteristics of the vehicle system 302 that may be considered when changing paths (e.g., weight or type of the vehicle system 302, number of units, direction of the vehicle system 302 as the vehicle system 302 approaches the turnout switch 314). Other route transition characteristics may include weather conditions at the intersection 312.

The transition plan 370 may also be configured to reduce the vehicle speed in a safe manner so that the units of the vehicle system 302 are not damaged or individuals harmed during the reduction in speed. More specifically, the planning module may consider a total weight of the vehicle system, individual weights of the units (e.g., rail cars and powered units), and a type(s) of mechanical couplers that join the individual units. Different mechanical couplers may be configured to withstand different levels of tensile force.

The prospective plan 372 may be implemented after the transition plan 370 has been implemented and/or after the designated operating parameter has been achieved. The prospective plan 372 includes designated tractive and/or braking operations for the vehicle system 302 after the approaching location (e.g., the intersection 312). In the illustrated embodiment, the prospective plan 372 corresponds to a portion of the route that begins at the intersection 312 and extends therefrom. In other embodiments, the prospective plan 372 may correspond to a location before the intersection 312 and also correspond to a portion of the route that extends beyond the intersection 312.

In particular embodiments, the prospective plan 372 is generated with one or more operating characteristics or constraints being assigned a weight that is greater than the weight assigned to the one or more characteristics or constraints when the transition plan 370 was generated. For instance, the prospective plan 372 may be configured to reduce fuel usage and/or emissions generated by the vehicle system 302 while satisfying other conditions (e.g., arrival time at the next scheduled stop). The transition plan 370, however, may not be configured to reduce fuel usage and/or emission generation. Instead, the transition plan 370 may include braking operations that reduce the speed of the vehicle system 302 to the designated amount as quickly as possible while satisfying other conditions (e.g., without damaging the vehicle system 302 or any cargo on the vehicle system 302). In such embodiments, the vehicle system 302 may achieve the designated speed a substantial distance before the turnout switch 314. For example, if the vehicle system 302 was 3000 feet (or 915 meters) from the turnout switch 314 when the transition plan 370 is initially implemented, the vehicle system 302 may achieve the designated speed 1000 feet (or 457 meters) from the turnout switch 314 instead of, for instance, achieving the designated speed immediately before or just at the turnout switch 314. In other embodiments, the transition plan 370 is configured so that the vehicle system 302 achieves the designated speed immediately before or just at the turnout switch 314.

In some embodiments, the transition plan 370 may be generated using fewer computing resources than involved or used during generation of the prospective plan 372. The transition plan 370 may be generated in less time than the prospective plan 372. For example, the planning module may generate the transition plan 370 in approximately 5 seconds and generate the prospective plan 370 in 45 seconds to a minute. More specifically, the transition plan 370 may have fewer factors and/or number of calculations such that generating the transition plan 370 may take less time than generating the prospective plan 372. For example, the transition plan 370 may correspond to a shorter distance along the route and, as such, fewer changes in track dimensions may be considered. The transition plan 370 may also sacrifice fuel efficiency in order to achieve the designated vehicle speed more quickly.

By way of example, when a planned deviation from an operating plan is received (e.g., in the form of an instruction) and/or a deviation occurs or is performed, one or more embodiments described herein may relatively quickly generate a transition plan in order to get the vehicle system "back on track" to following the operating plan, or at least to another operating plan that also reduces fuel consumption and/or emissions generation. The transition plan may not be as efficient in terms of reducing fuel consumption and/or emissions generation, but can cause the vehicle system to move to a location in an amount of time that allows the vehicle system to follow a prospective plan. The prospective plan can allow the vehicle system to continue to travel over a longer distance (e.g., the remainder of the trip) while reducing fuel consumed and/or emissions generated. The transition plan may be considered as a relatively "quick fix" to a deviation from a previous operating plan so that the vehicle system can return to a prospective plan, which may be considered as a modified operating plan for at least a portion or the entirety of the remainder of the trip.

As described above, the transition plan 370 may be triggered by a deviation in vehicle speed alone without diverging or changing routes. Under such circumstances, because the vehicle system is not changing routes, the planning module may also consider speed limits that exist beyond the approaching location by which the vehicle system must have the speed reduced. The planning module may analyze the route for any speed limits that are even less than the requested speed reduction. For instance, the planning module may examine the currently-implemented plan (or route data) to identify any speed restrictions that occur soon after the approaching location. By way of one specific example, the vehicle system may be instructed to reduce the vehicle speed to 40 mph by 3000 feet from the current location of the vehicle system. However, because the deviation does not include changing routes, the planning module may examine the currently-implemented operating plan (or route data) to identify any speed limits within a designated distance after the approaching location (e.g., after 3000 feet from the current location). For example, the planning module may analyze the currently-implemented operating plan to identify speed limits 5000 feet beyond the 3000 feet instruction. If the planning module identifies a speed limit within this designated distance that is less than the requested speed reduction (e.g., less than 40 mph), the planning module may generate a transition plan that reduces the speed further than instructed. For example, if the speed limit identified after the approaching location is 20 mph, the transition plan may reduce the vehicle speed to 20 mph.

The planning module and the vehicle control module may be configured to implement the operating plan, the transition plan 370, and the prospective plan 372 so that the vehicle system 302 transitions continuously from the operating plan to the transition plan 370 and from the transition plan 370 to the prospective plan 372. For instance, the planning module may determine that an initial speed of the vehicle system 302 at a beginning of the transition plan 370 is substantially equal to the speed of the vehicle system 302 immediately before the operating plan was interrupted and the transition plan 370 was implemented. Also, an initial speed of the vehicle system 302 at a beginning of the prospective plan 372 may be substantially equal to a final speed of the vehicle system 302 at an end of the transition plan 370. In some embodiments, the initial speed of the vehicle system 302 at a beginning of the prospective plan 372 is substantially equal to the speed of the vehicle system 302 immediately before the transition plan 370 was interrupted and the prospective plan 372 was implemented.

In particular embodiments, the operating plan, the transition plan 370, and the prospective plan 372 are automatically executed by the vehicle control and planning modules of the control system. For example, after the input is provided to deviate from the operating plan, the vehicle system 302 may not require or prompt the operator for additional information or instruction. Accordingly, automatic control of the vehicle system 302 may be maintained throughout the track divergence even though the track divergence was not part of the original operating plan.

The method 350 may also include generating (at 360) another prospective plan 374. The prospective plans 372, 374 may be referred to as first and second prospective plans. Like the prospective plan 372, the prospective plan 374 includes designated tractive and/or braking operations for the vehicle system 302. However, the designated tractive and/or braking operations of the prospective plan 374 may correspond to a portion of the route that extends beyond the point J. In some cases, the prospective plan 374 may extend to the scheduled final destination of the trip plan.

The prospective plan 374 is generated with one or more operating characteristics or constraints being assigned a weight that is greater than the weight assigned to the one or more characteristics or constraints when the transition plan 370 was generated. Like the prospective plan 372, the prospective plan 374 may be configured to reduce fuel usage and/or emissions generation while satisfying other conditions (e.g., arrival time at the next scheduled stop).

In the illustrated embodiment, the transition plan 370 and the prospective plans 372, 374 are configured to overlap each other. In some embodiments, a previous or prior operating plan may be configured so that the planning module has sufficient time to generate the subsequent operating plan. For example, because generation of the first prospective plan 372 may require substantial computing resources and time, in some embodiments, the transition plan 370 is configured so that a sufficient time exists for the planning module to generate the first prospective plan 372. More specifically, the time used by the planning module to generate an operating plan may be referred to as the generation time. The generation time for operating plans may vary because the number of calculations for generating the plans may be based on a plurality of variables (e.g., length and topography of the route, turns along the route, regulations along the route, number of stops along the route, etc.). By way of example, the generation time for a relatively simple operating plan may be about 30 seconds, but a more complex operating plan may be about 5 minutes. Thus, the transition plan 370 may be configured to be implemented for a designated time period and/or to a designated location along the route so that a sufficient amount of time exists for the first prospective plan 372 to be generated. Depending upon the complexity of the first prospective plan 372, the first prospective plan 372 may be completely generated before the end of the transition plan 370 with a larger amount of time remaining (if the first prospective plan 372 is relatively simple) or with a smaller amount of time remaining (if the first prospective plan 372 is relatively complex) in the transition plan 370.

In some embodiments, the first prospective plan 372 may be configured so that fewer calculations are used to generate the first prospective plan 372. Such embodiments may facilitate completing the first prospective plan 372 before the transition plan 370 has been fully implemented. For example, the length of the route that the first prospective plan 372 is based on may be limited so that the number of calculations for generating the first prospective plan 372 may be reduced. Reducing the number of calculations for the first prospective plan 372 may reduce the generation time of the first prospective plan 372. In this manner, the first prospective plan 372 may be generated before implementation of the transition plan 370 has completed. By way of one example, the first prospective plan 372 may only correspond to 10 to 15 miles (e.g., 16.1 to 24.1 kilometers) of the route.

Similar to the transition plan 370, the first prospective plan 372 may be configured so that the planning module has sufficient time to generate the second prospective plan 374. Since the second prospective plan 374 may correspond to a much greater distance than the first prospective plan 372 (e.g., hundreds to thousands of miles or hundreds to thousands kilometers), the computing resources and/or time necessary to complete the generation of the second prospective plan 374 may be even greater the computing resources and/or time that were used to generate the first prospective plan 372. The first prospective plan 372 may be configured to be implemented for a designated time period and/or to a designated location along the route so that a sufficient amount of time exists for the second prospective plan 374 to be generated. Thus, in some embodiments, the generation time for the transition plan 370 is less than the generation time for the first prospective plan 372, which may be less than the generation time for the second prospective plan 374.

When generating the first and second prospective plans 372, 374, the planning module may consider the previous operating plan to determine a location where the previous operating plan may be interrupted and replaced by the next operating plan. For example, while the transition plan 370 is being implemented, the planning module may be generating the first prospective plan 372. The planning module may analyze the transition plan 370 and identify a point within the transition plan 370 where the transition plan 370 may be interrupted and replaced by the first prospective plan 372. This point may be referred to as a plan interruption location. A plan interruption location may represent a location along a route being traveled by the vehicle system 302 according to a first operating plan where the vehicle system 302 may deviate from the operating plan. For example, a plan interruption location may represent an intersection or switch in the route or a location along the route where the vehicle system 302 is at a modified speed. In FIG. 3, this location is at point I. Accordingly, at point I, the transition plan 370 may be replaced by the first prospective plan. The first prospective plan 372 may be characterized as being "stitched" onto the transition plan 370. More specifically, the planning module may determine that an initial speed of the vehicle system 302 at a beginning of the prospective plan 372 may be substantially equal to a speed of the vehicle system 302 at the point I. In a similar manner, the second prospective plan 374 may replace the first prospective plan 372.

After completing the transition plan 370 and the first and second prospective plans 372, 374, in some embodiments, the vehicle system 302 may store the "stitched" plans as a composite plan 376. The composite plan 376 may be communicated to the network system 316. In some cases, the composite plan 376 may then be recalled by the vehicle system 302 (or other vehicle systems) if similar circumstances occur at a later time.

In one embodiment, a system is provided that includes a vehicle control module that is configured to control a vehicle system during a trip according to an operating plan. The operating plan designates one or more first tractive operations or braking operations to be implemented by the vehicle system along a route of the trip. The system also includes a planning module that is configured to generate a transition plan in response to a deviation of the vehicle system from the operating plan. The deviation may be, for example, a change in route or a change in speed (e.g., a designated increase or decrease in speed) or an instruction to do the same. The transition plan designates one or more second tractive operations or braking operations to be implemented by the vehicle system to achieve a designated operating parameter prior to an approaching location along the route. The vehicle control module is configured to control operation of the vehicle system according to the transition plan as the vehicle system travels toward the approaching location from a location where the vehicle system deviates from the operating plan. The planning module is further configured to generate a prospective plan in response to the deviation. The prospective plan designates one or more third tractive operations or braking operations to be implemented by the vehicle system when the vehicle system at least one of moves past the approaching location or completes the transition plan.

With respect to the tractive operations and braking operations of the plans described herein, the terms first, second, and third are merely labels to distinguish the operations of one plan from operations of another plan, and are not meant to indicate a particular order or that the operations of a given plan are necessarily the same.

In one embodiment, a system is provided that includes a vehicle control module configured to control a vehicle system during a trip according to an operating plan. The operating plan designates one or more first tractive operations or braking operations to be implemented by the vehicle system along a route of the trip. The system also includes a planning module that is configured to generate a transition plan in response to a deviation of the vehicle system from the operating plan. The transition plan designates one or more second tractive operations or braking operations to be implemented by the vehicle system as the vehicle system travels toward an approaching location from a second location where the vehicle system deviates from the operating plan. The planning module is further configured to generate a prospective plan in response to the deviation. The prospective plan designates one or more third tractive operations or braking operations to be implemented by the vehicle system when the vehicle system at least one of moves past the approaching location or completes the transition plan.

In one aspect, the transition plan may designate the one or more second tractive operations or braking operations to be implemented by the vehicle system to achieve a designated operating parameter prior to the approaching location along the route. The vehicle control module may be configured to control operation of the vehicle system according to the transition plan as the vehicle system travels toward the approaching location from the second location.

In one aspect, the planning module is configured to generate the transition plan in response to receiving an input request to deviate from the operating plan. For example, the input request may be received from on-board the vehicle system or from off-board the vehicle system. The deviation may be detected automatically when the vehicle system actually deviates from the operating plan. The input request may include an instruction to modify the route being traveled by the vehicle system by changing which route segments of the route are traveled by the vehicle system at an intersection at the approaching location.

In one aspect, the deviation includes an instruction to modify a current speed of the vehicle system to a different speed at or before the approaching location.

In another aspect, the planning module is configured to generate the prospective plan while the vehicle system is traveling according to the transition plan.

In another aspect, the designated operating parameter is vehicle speed.

In another aspect, the vehicle system transitions continuously from the operating plan to the transition plan and from the transition plan to the prospective plan. For instance, an initial speed of the vehicle system at a beginning of the prospective plan is substantially equal to a final speed of the vehicle system at an end of the transition plan.

In another aspect, the vehicle system is a rail vehicle system that includes at least one locomotive. The transition plan is based on a switch characteristic of a turnout switch that guides the rail vehicle system from a current track to a joining track. The switch characteristic includes at least one of (a) a diverging angle between the current and joining tracks or (b) a type of the turnout switch.

In another aspect, the planning module is configured, in at least one mode of operation, to analyze fewer factors while generating the transition plan than a number of factors analyzed while generating the prospective plan.

In another aspect, each of the operating and prospective plans is generated based on fuel usage. The transition plan may not be generated based on fuel usage.

In another aspect, the braking operations of the transition plan are configured to reduce a speed of the vehicle system to at least a designated amount before the approaching location.

In another aspect, the prospective plan controls the operation of the vehicle system for only a segment of the route. The vehicle control module is configured to receive another operating plan that controls the operation of the vehicle system for a remainder of the route. The remainder of the route being longer than the segment.

In another aspect, the vehicle control and planning modules are configured to be disposed on-board the vehicle system.

In one embodiment, a method is provided that includes controlling a vehicle system according to an operating plan. The operating plan designates one or more first tractive operations or braking operations to be implemented by the vehicle system along a route of a trip. The method also includes generating a transition plan in response to a deviation of the vehicle system from the operating plan. The transition plan designates one or more second tractive operations or braking operations to be implemented by the vehicle system to achieve a designated operating parameter prior to an approaching location along the route. The method also includes generating a prospective plan in response to the deviation from the operating plan. The prospective plan designates one or more third tractive operations or braking operations to be implemented by the vehicle system when the vehicle system at least one of moves past the approaching location or completes the transition plan.

In one embodiment, a method is provided that includes controlling a vehicle system according to an operating plan. The operating plan designates one or more first tractive operations or braking operations to be implemented by the vehicle system along a route of a trip. The method also includes generating a transition plan in response to a deviation of the vehicle system from the operating plan. The transition plan designates one or more second tractive operations or braking operations to be implemented by the vehicle system prior to an approaching location along the route. The method also includes generating a prospective plan in response to the deviation from the operating plan. The prospective plan designates one or more third tractive operations or braking operations to be implemented by the vehicle system when the vehicle system at least one of moves past the approaching location or completes the transition plan.

In one aspect, the one or more second tractive operations or braking operations of the transition plan are configured to achieve a designated operating parameter prior to the approaching location.

In another aspect, generating the transition plan is in response to receiving an input request to deviate from the operating plan. For example, the input request may be received from on-board the vehicle system or from off-board the vehicle system. The input request may be detected automatically when the vehicle system actually deviates from the operating plan. The input request may include an instruction to modify the route being traveled by the vehicle system by changing which route segments of the route are traveled by the vehicle system at an intersection.

In another aspect, generating the prospective plan at least partially occurs while the vehicle system is being controlled according to the transition plan.

In another aspect, generating the transition plan includes analyzing fewer factors than a number of factors analyzed for generating the prospective plan.

In another aspect, generating the prospective plan includes basing the prospective plan on fuel usage. The transition plan may not be based on fuel usage.

In another aspect, generating the transition plan uses fewer computing resources than generating the prospective plan.

In another aspect, the braking operations of the transition plan are configured to reduce a speed of the vehicle system to at least a designated amount before the approaching location.

In another aspect, generating the transition plan is executed by a processor disposed on-board the vehicle system.

In one embodiment, a tangible and non-transitory computer readable medium that includes one or more software modules is provided. The computer readable medium is configured to direct a processor to control a vehicle system according to an operating plan. The operating plan designates one or more first tractive operations or braking operations to be implemented by the vehicle system along a route of a trip. The computer readable medium is configured to direct the processor to generate a transition plan in response to a deviation of the vehicle system from the operating plan. The transition plan designates one or more second tractive operations or braking operations to be implemented by the vehicle system to achieve a designated operating parameter prior to an approaching location along the route. The computer readable medium is also configured to direct the processor to generate a prospective plan in response to the deviation from the operating plan. The prospective plan designates one or more third tractive operations or braking operations to be implemented by the vehicle system when the vehicle system at least one of moves past the approaching location or completes the transition plan.

In one embodiment, a tangible and non-transitory computer readable medium that includes one or more software modules is provided. The computer readable medium is configured to direct a processor to control a vehicle system according to an operating plan. The operating plan designates one or more first tractive operations or braking operations to be implemented by the vehicle system along a route of a trip. The computer readable medium is also configured to generate a transition plan in response to a deviation of the vehicle system from the operating plan. The transition plan designates one or more second tractive operations or braking operations to be implemented by the vehicle system prior to an approaching location along the route. The computer readable medium is also configured to generate a prospective plan in response to the deviation from the operating plan. The prospective plan designates one or more third tractive operations or braking operations to be implemented by the vehicle system when the vehicle system at least one of moves past the approaching location or completes the transition plan.

In one aspect, the one or more second tractive operations or braking operations of the transition plan are configured to achieve a designated operating parameter prior to the approaching location.

In another aspect, the processor is directed to execute the method operations described above.

In another embodiment, a system is provided that includes a vehicle control module that is configured to control a vehicle by implementing successive operating plans along a route of a trip. The operating plans may include an operating plan, a transition plan, and a prospective plan. The operating plan designates one or more first tractive or braking operations to be implemented by the vehicle until at least a remote point along a route of a trip. The transition plan is generated in response to an input that requests the vehicle to deviate from the operating plan. The transition plan designates one or more second tractive or braking operations to be implemented by the vehicle to achieve a designated operating parameter prior to a local point or location, such as an intersection, along the route. The prospective plan designates one or more third tractive or braking operations to be implemented by the vehicle past the local point along the route. In some embodiments, an additional prospective plan may be generated that follows the initial prospective plan.

As used herein, the terms "system" and "module" include a hardware and/or software system that operates to perform one or more functions. For example, a module or system may include a computer processor, controller, or other logic-based device that performs operations based on instructions stored on a tangible and non-transitory computer readable storage medium, such as a computer memory. Alternatively, a module or system may include a hard-wired device that performs operations based on hard-wired logic of the device. The modules shown in the attached figures may represent the hardware that operates based on software or hardwired instructions, the software that directs hardware to perform the operations, or a combination thereof.

As used herein, an element or step recited in the singular and proceeded with the word "a" or "an" should be understood as not excluding plural of said elements or steps, unless such exclusion is explicitly stated. Furthermore, references to "one embodiment" of the presently described inventive subject matter are not intended to be interpreted as excluding the existence of additional embodiments that also incorporate the recited features. Moreover, unless explicitly stated to the contrary, embodiments "comprising," "comprises," "including," "includes," "having," or "has" an element or a plurality of elements having a particular property may include additional such elements not having that property.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. While the dimensions and types of materials described herein are intended to define the parameters of the inventive subject matter, they are by no means limiting and are exemplary embodiments. Many other embodiments will be apparent to one of ordinary skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose several embodiments of the inventive subject matter, and also to enable one of ordinary skill in the art to practice the embodiments of inventive subject matter, including making and using any devices or systems and performing any incorporated methods. The patentable scope of the inventive subject matter is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

The foregoing description of certain embodiments of the present inventive subject matter will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (for example, controllers or memories) may be implemented in a single piece of hardware (for example, a general purpose signal processor, microcontroller, random access memory, hard disk, and the like). Similarly, the programs may be stand-alone programs, may be incorporated as subroutines in an operating system, may be functions in an installed software package, and the like. The various embodiments are not limited to the arrangements and instrumentality shown in the drawings.

What is claimed is:

1. A system having one or more processing units configured to:

control a vehicle system during a trip according to an operating plan, the operating plan designating one or more first tractive operations or braking operations to be implemented by the vehicle system along a route of the trip;

generate a transition plan in response to a deviation of the vehicle system from the operating plan, the transition plan designating one or more second tractive operations or braking operations to be implemented by the vehicle system as the vehicle system travels toward an approaching location from a second location where the vehicle system deviates from the operating plan, wherein the transition plan designates the one or more second tractive operations or braking operations for the vehicle system for a limited distance that is shorter than a remainder of a distance for which the operating plan was generated; and generate a prospective plan in response to the deviation, the prospective plan designating one or more third tractive operations or braking operations to be implemented by the vehicle system when the vehicle system at least one of moves past the approaching location or completes the transition plan, wherein the prospective plan designates the one or more third tractive operations or braking operations for the vehicle system at least until an end point of the distance for which the operating plan was generated.

2. The system of claim 1, wherein the transition plan designates the one or more second tractive operations or braking operations to be implemented by the vehicle system to achieve a designated operating parameter prior to reaching the approaching location along the route, and wherein the one or more processing units are configured to control operation of the vehicle system according to the transition plan as the vehicle system travels toward the approaching location from the second location.

3. The system of claim 1, wherein the one or more processing units are configured to generate the transition plan in response to receiving an input request to deviate from the operating plan.

4. The system of claim 1, wherein the deviation is detected automatically when the vehicle system actually deviates from the operating plan.

5. The system of claim 1, wherein the deviation includes an instruction to modify the route being traveled by the vehicle system by changing which route segments of the route are traveled by the vehicle system at an intersection at the approaching location.

6. The system of claim 1, wherein the deviation includes an instruction to modify a current speed of the vehicle system to a different speed at or before the approaching location.

7. The system of claim 1, wherein the one or more processing units are configured to generate the prospective plan while the vehicle system is traveling according to the transition plan.

8. The system of claim 1, wherein the vehicle system transitions continuously from the operating plan to the transition plan and from the transition plan to the prospective plan.

9. The system of claim 8, wherein an initial speed of the vehicle system at a beginning of the prospective plan is substantially equal to a final speed of the vehicle system at an end of the transition plan.

10. The system of claim 1, wherein the transition plan designates the one or more second tractive operations or braking operations to be implemented by the vehicle system to achieve a designated vehicle speed prior to reaching the approaching location along the route.

11. The system of claim 1, wherein the vehicle system is a rail vehicle system that includes at least one locomotive, the transition plan being based on a switch characteristic of a turnout switch that guides the rail vehicle system from a current track to a joining track, the switch characteristic including at least one of a diverging angle between the current and joining tracks or a type of the turnout switch.

12. The system of claim 1, wherein the one or more processing units are configured, in at least one mode of operation, to analyze fewer factors while generating the transition plan than a number of factors analyzed while generating the prospective plan.

13. The system of claim 1, wherein the prospective plan is generated based, at least in part, on fuel usage and wherein the transition plan is not generated based on fuel usage.

14. The system of claim 1, wherein the braking operations of the transition plan are configured to reduce a speed of the vehicle system to at least a designated amount before the approaching location.

15. The system of claim 1, wherein the prospective plan controls the operation of the vehicle system for only a segment of the route, the one or more processing units configured to receive another operating plan that controls the operation of the vehicle system for a remainder of the route, the remainder of the route being longer than the segment.

16. The system of claim 1, wherein the one or more processing units are configured to be disposed on-board the vehicle system.

17. A method comprising:

controlling a vehicle system according to an operating plan, the operating plan designating one or more first tractive operations or braking operations to be implemented by the vehicle system along a route of a trip;

generating a transition plan in response to a deviation of the vehicle system from the operating plan, the transition plan designating one or more second tractive operations or braking operations to be implemented by the vehicle system prior to an approaching location along the route, wherein the transition plan designates the one or more second tractive operations or braking operations for the vehicle system for a limited distance that is shorter than a remainder of a distance for which the operating plan was generated; and generating a prospective plan in response to the deviation from the operating plan, the prospective plan designating one or more third tractive operations or braking operations to be implemented by the vehicle system when the vehicle system at least one of moves past the approaching location or completes the transition plan, wherein the prospective plan designates the one or more third tractive operations or braking operations for the vehicle system at least until an end point of the distance for which the operating plan was generated.

18. The method of claim 17, wherein the one or more second tractive operations or braking operations of the transition plan are configured to achieve a designated operating parameter prior to the approaching location.

19. The method of claim 17, further comprising automatically detecting the deviation is when the vehicle system actually deviates from the operating plan.

20. The method of claim 17, further comprising receiving an input request as the deviation, the input request including an instruction to modify the route being traveled by the vehicle system by changing which route segments of the route are traveled by the vehicle system at an intersection.

21. The method of claim 17, wherein generating the prospective plan at least partially occurs while the vehicle system is being controlled according to the transition plan.

22. The method of claim 17, wherein generating the transition plan includes analyzing fewer factors than a number of factors analyzed for generating the prospective plan.

23. The method of claim 17, wherein generating the prospective plan includes basing the prospective plan on fuel usage while the transition plan is not based on fuel usage.

24. A tangible and non-transitory computer readable medium that includes one or more software modules configured to direct a processor to:

control a vehicle system according to an operating plan, the operating plan designating one or more first tractive operations or braking operations to be implemented by the vehicle system along a route of a trip;

generate a transition plan in response to a deviation of the vehicle system from the operating plan, the transition plan designating one or more second tractive operations or braking operations to be implemented by the vehicle system prior to an approaching location along the route, wherein the transition plan designates the one or more second tractive operations or braking operations for the vehicle system for a limited distance that is shorter than a remainder of a distance for which the operating plan was generated; and generate a prospective plan in response to the deviation from the operating plan, the prospective plan designating one or more third tractive operations or braking operations to be implemented by the vehicle system when the vehicle system at least one of moves past the approaching location or completes the transition plan, wherein the prospective plan designates the one or more third tractive operations or braking operations for the vehicle system at least until an end point of the distance for which the operating plan was generated.

25. The computer readable medium of claim 24, wherein the one or more second tractive operations or braking operations of the transition plan are configured to achieve a designated operating parameter prior to the approaching location.

26. The computer readable medium of claim 24, wherein the one or more software modules are configured to direct the processor to automatically detect the deviation when the vehicle system actually deviates from the operating plan.

27. The computer readable medium of claim 24, wherein the one or more software modules are configured to direct the processor to receive the deviation as an instruction to modify the route being traveled by the vehicle system by changing which route segments of the route are traveled by the vehicle system at an intersection.

28. The computer readable medium of claim 24, wherein the one or more software modules are configured to direct the processor to generate the prospective plan at least partially while the vehicle system is being controlled according to the transition plan.

29. The computer readable medium of claim 24, wherein the one or more software modules are configured to direct the processor to base the prospective plan on fuel usage while the transition plan is not based on fuel usage.

30. The computer readable medium of claim 24, wherein the one or more software modules are configured to direct the processor to generate the braking operations of the transition plan in order to reduce a speed of the vehicle system to at least a designated amount before the approaching location.

* * * * *